US011210909B2

(12) United States Patent
Whytock et al.

(10) Patent No.: US 11,210,909 B2
(45) Date of Patent: Dec. 28, 2021

(54) VALUABLE MEDIA HANDLING DEVICE WITH SECURITY PROCESSOR

(71) Applicant: NCR Corporation, Duluth, GA (US)

(72) Inventors: Alexander William Whytock, Perthshir (GB); Philip Keith Staff, Dunfermline (GB)

(73) Assignee: NCR Corporation, Atlanta, GA (US)

( * ) Notice: Subject to any disclaimer, the term of this patent is extended or adjusted under 35 U.S.C. 154(b) by 0 days.

(21) Appl. No.: 15/827,191

(22) Filed: Nov. 30, 2017

(65) Prior Publication Data

US 2019/0164389 A1 May 30, 2019

(51) Int. Cl.
*G07F 19/00* (2006.01)

(52) U.S. Cl.
CPC ..... *G07F 19/206* (2013.01); *G07F 19/202* (2013.01); *G07F 19/205* (2013.01); *G06Q 2220/00* (2013.01)

(58) Field of Classification Search
CPC .... G07F 19/206; G07F 19/202; G07F 19/205; G06Q 2220/00
See application file for complete search history.

(56) References Cited

U.S. PATENT DOCUMENTS 7,890,769 B2 * 2/2011 Chen ..... G06F 21/572 713/190
9,015,075 B2 * 4/2015 Hughes ..... G06Q 20/30 705/50
2004/0103224 A1 * 5/2004 Duresky ..... G06F 13/4059 710/52
2005/0160050 A1 * 7/2005 Payne ..... G06Q 20/382 705/64

OTHER PUBLICATIONS http://vikingsecuritysafe.com/product-detail/viking-vs-14bl-top-opening-drawer-safe/, Oct. 1, 2016, www.vikingsecuritysafe.com (Year: 2016).*

* cited by examiner

*Primary Examiner* — Jeffrey S Vanderveen
(74) *Attorney, Agent, or Firm* — Schwegman, Lundberg & Woessner

(57) ABSTRACT

A valuable media handling device is presented having two security processors. A top box for an escrow module of the valuable media handling device includes a master security processor. The master security processor is connected to a slave security processed located within a safe of the valuable media handling device via an internal bus connection. The master security processor controls and validates operations and modules of the valuable media handling device and the slave security processor controls and validates operations that access the safe for depositing or dispensing valuable media from the safe.

5 Claims, 5 Drawing Sheets

VALUABLE MEDIA HANDLING DEVICE WITH SECURITY PROCESSOR

BACKGROUND

Media handling devices, particularly Automated Teller Machines (ATMs) include a variety of independent devices integrated into the ATM. The cash handling components are frequently a target by criminals, since these components have cash that the criminals want to steal out of the ATM.

The ATM includes a variety of cooperating processors for the various integrated components. Security is of utmost concern and still there are a number of vulnerable operations that expose the cash handing components to being compromised by criminals. Two such sensitive operations are dispensing cash/notes and depositing cash/notes both of which require user authentication to be performed on the ATM. Additionally, each component of the ATM that is required to service the sensitive operations is required to perform its own independent authentication for the operations. For example, a recycler (component having cash/notes) must authenticate for deposit and dispense operations using cryptographic keys and cryptographic techniques.

However, the cryptographic techniques and keys are exposed in varying levels of degree within the components of the ATM during the authentication process by the recycler. The techniques and keys are also exposed during ATM maintenance and during remote software loading/installation at the ATM.

A significant amount of resources have been directed to reducing the exposure level of the cryptographic techniques and keys within ATMs. However, the criminals are ingenious and are continually evolving to change tactics based on industry adjustments to the design and operation of the ATMs.

SUMMARY

In various embodiments, a valuable media handling device with a security processor and methods for operating a valuable media handling device with a security processor are provided.

According to an embodiment, a valuable media handling device with two security processors are provided. The first security processor located in a top box outside a safe and is configured to control and validate modules of and operations being processed on the valuable media handling device. The first security processor is connected to a second security processor via an internal bus connection. The second security processor located inside the safe and is configured to validate and control the safe and operations being processed to dispense valuable media from the safe and deposit valuable media into the safe.

DETAILED DESCRIPTION

Figure 1A:
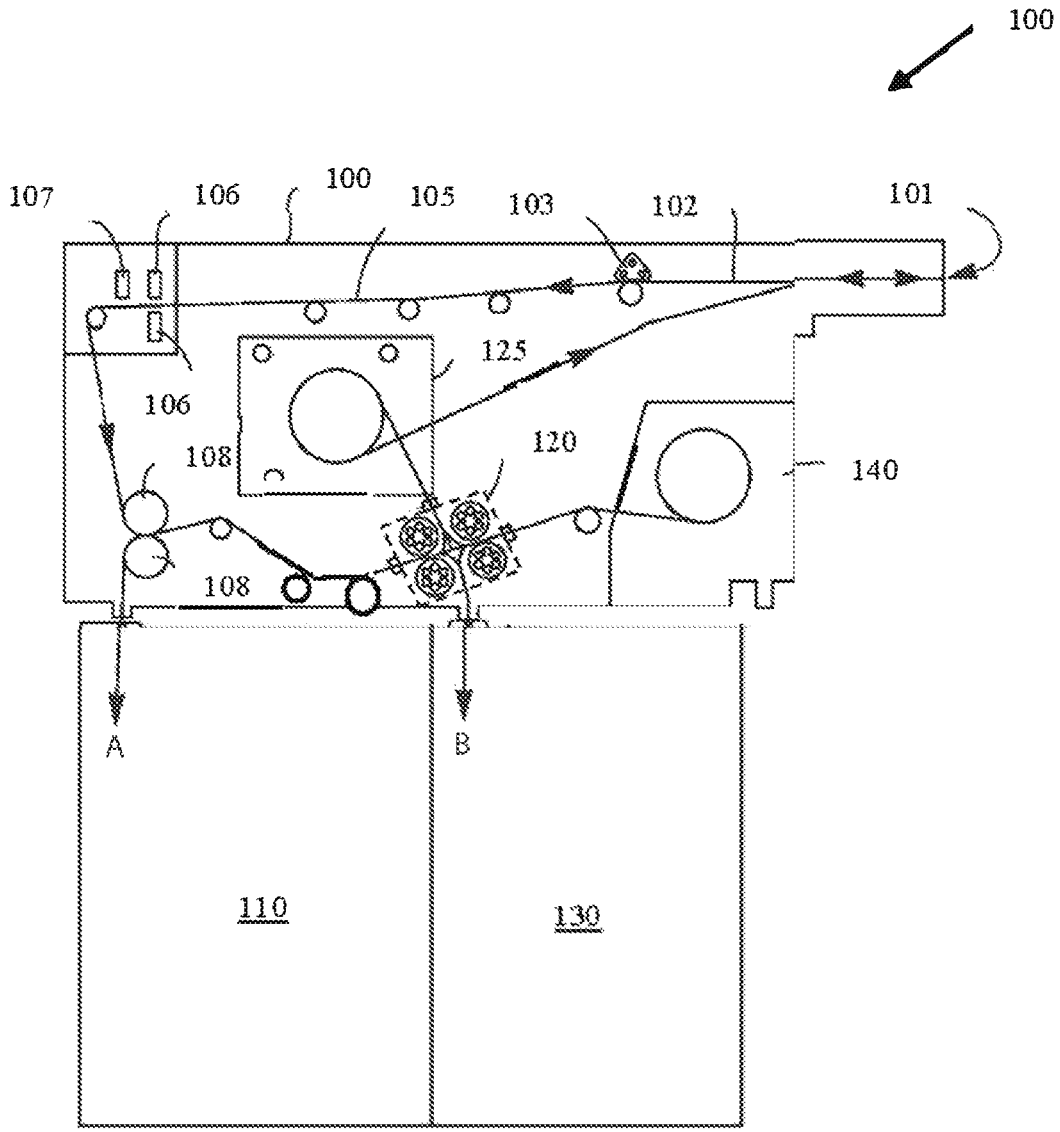
FIG. 1A is a diagram depicting a deposit/dispense module of a Self-Service Terminal, according to an example embodiment.

FIG. 1A is a diagram depicting a one-sided view of a pick module for a valuable media depository 100, according to an example embodiment. It is to be noted that the valuable media depository is shown with only those components relevant to understanding the various embodiments presented herein for a valuable media handling device with dual security processors.

FIG. 1A illustrates a deposit module 100 (valuable media depository) suitable for use within an ATM, which can be utilized to process deposited/dispensed banknotes and checks (valuable media as a mixed bunch if desired). The deposit module 100 has an access mouth 101 through which incoming checks and/or banknotes are deposited or outgoing checks and/or banknotes are dispensed. This mouth 101 is aligned with an infeed aperture in the ATM, which thus provides an input/output slot. A bunch (stack) of one or more items (value media) is input or output. Incoming checks and/or banknotes follow a first transport path 102 away from the mouth 101 in a substantially horizontal direction from right to left shown in the FIG. 1A. They then pass through a feeder/separator 203 and along another pathway portion 105, which is also substantially horizontal and right to left. The items are then de-skewed and read by imaging cameras 106 and a Magnetic Ink Character Recognition (MICR) reader 107.

Items are then are directed substantially vertically downwards to a point between two nip rollers 108. These nip rollers cooperate and are rotated in opposite directions with respect to each other to either draw deposited checks and/or banknotes inwards (and urge those checks and/or banknotes towards the right hand side in the FIG. 1A), or during another mode of operation, the rollers can be rotated in an opposite fashion to direct processed checks and/or banknotes downwards in the direction shown by arrow A in the FIG. 1A into a check or banknote bin 110. Incoming checks and/or banknotes, which are moved by the nip rollers 108 towards the right, enter a diverter mechanism 120. The diverter mechanism 120 can either divert the incoming checks and/or banknotes upwards (in the FIG. 1A) into a re-buncher unit 125, or downwards in the direction of arrow B in the FIG. 1A into a cash bin 130, or to the right hand side shown in the FIG. 1A into an escrow 140. Items of media from the escrow 140 can selectively be removed from the drum and re-processed after temporary storage. This results in items of media moving from the escrow 140 towards the left hand side of the FIG. 1A where again they will enter the diverter mechanism 120. The diverter mechanism 120 can be utilized to allow the transported checks and/or banknotes to move substantially unimpeded towards the left hand side and thus the nip rollers 108 or upwards towards the re-buncher 125. Currency notes from the escrow can be directed to the re-buncher 125 or downwards into the banknote bin 130.

As used herein, the phrase "valuable media" refers to media of value, such as currency, coupons, checks, negotiable instruments, value tickets, and the like.

For purposes of the discussions that follow with respect to the FIGS. 1A-1B and 2-4, "valuable media" is referred to as currency and the "valuable media depository" is referred to as a "valuable media handling device." Additionally, valuable media may be referred to as a "document" herein.

Figure 1B:
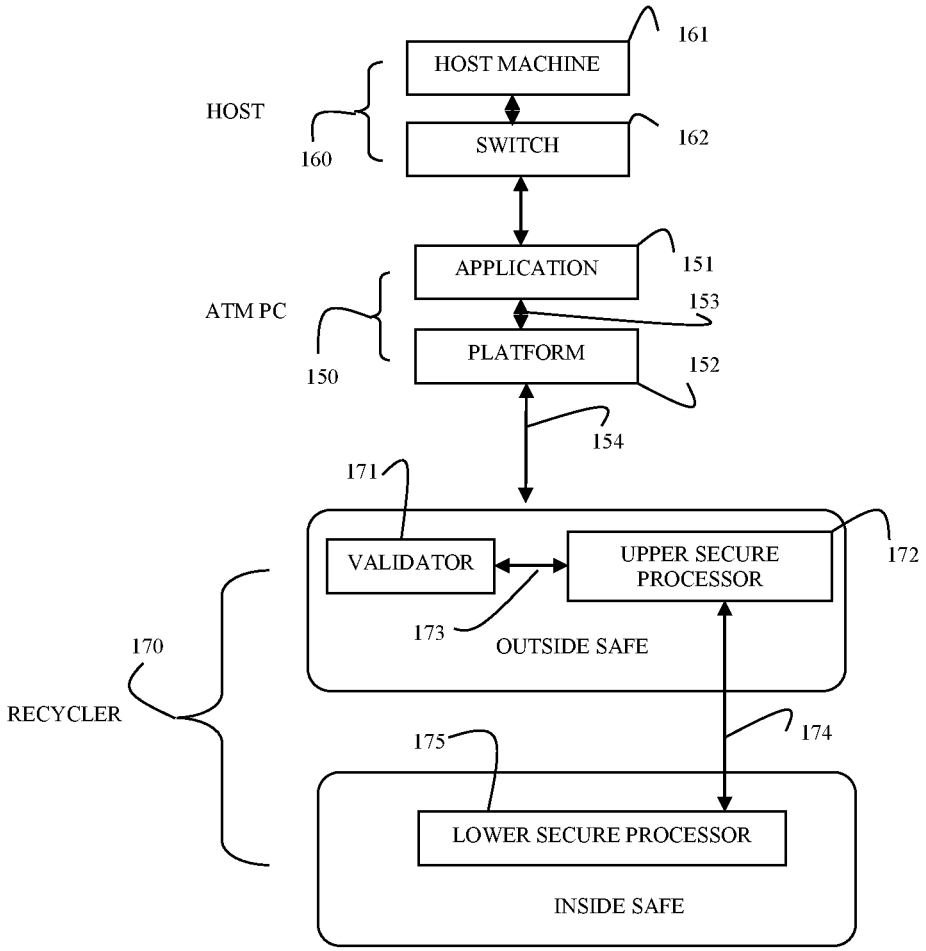
FIG. 1B is a diagram depicting an architecture for a valuable media handling device with two security processors, according to an example embodiment.

FIG. 1B is a diagram depicting an architecture for a valuable media handling device with two security processors, according to an example embodiment.

Conventionally, components of an ATM have a single secure processor, which is embedded in an encrypted Personal Identification Number (PIN) pad and used for encrypted a customer's PIN during a transaction. The encrypted pin is sent in an encrypted format from the ATM to the switch and a host financial institution where it is authenticated.

There are a number of other scenarios that are of concern on ATMs in terms of security, such as malicious software that implements attacks to: fool a customer into making a deposit and return the deposit to a criminal (malware cash trap), and dispense cash from the recycler module to a criminal (malware cash dispense). For malware cash trap the commands that are vulnerable include: open shutter, close shutter, count, and store. For malware cash dispense the commands that are vulnerable include stack.

As will be discussed more completely here, a valuable media handling device 100 includes dual secure processors architecturally arranged as shown in the FIG. 1B.

As used herein, a "security processor" is a processor that is PCI-certified, includes: encryption engines; tamper pins and secure key storage; voltage, frequency, temperature monitors and a die active shield; on-the-fly encryption/decryption, and a secure boot procedure. The processor pins are protected by an encasing Printed Circuit Board (PCB) mesh. The PCB mesh is connected to the processor's tamper responsive circuit, such that when the mesh is broken, the encryption keys are erased.

In an embodiment, the security processors are Atmel processors ATSAMA5D28 and/or ATSAMA5D2.

The valuable media handling device 100 includes a recycler 170 that includes a top encasing (top box) located outside the safe and a safe. The top box (outside the safe) includes an upper secure processor 172 and a validator module 171. The upper secure processor 172 is connected via an internal bus connection 174 to the lower secure processor 175, which is located inside the safe of the valuable media handling device 100.

The upper secure processor 172 is responsible for operations being performed and validated within the valuable media handling device 100 and is the master processor 172 for the valuable media handling device 100. The lower secure processor 175 is responsible for operations that control access to the cash/currency cassettes. The master processor 172 controls commands to dispense case to the lower processor 175 and only an internal bus connection 174 exists between the master processor 172 and the slave processor 175 (which is physically located within the cash safe of the valuable media handling device 100).

Within the top box, the master processor 172 is connected to the validator module 171 via an Ethernet connection.

A Universal Serial Bus (USB) connection 154 is made between the master processor 172 in the top box to the Personal Computer (PC) core 150. The core 150 includes the platform 152 and the transaction applications 151. An Application Programming Interface (API) is used for communication between the platform 152 and the applications 151, such API may include CEN XFS.

A network connection between the valuable media handling device 100 and the application 151 is made to access a financial switch 162 for authenticating transaction information during a transaction with a host 160 and its host machine 161.

The architecture depicted in the FIG. 1B significantly reduces vulnerabilities in processing sensitive operations within the valuable media handling device 100. Conventionally, processors were not secure processors and when dual processors were used the connection between the upper and lower processors were made via Ethernet and not internal bus connections with an additional connection directly from the lower processor to the platform via Ethernet (making it possible to directly access from the platform and application of the core the safe and provided commands to dispense cash). These conventional vulnerabilities are alleviated with the architecture having dual security processors 172 (master) and 175 (slave).

These and other embodiments are now discussed with reference to the FIGS. 2-4.

Figure 2:
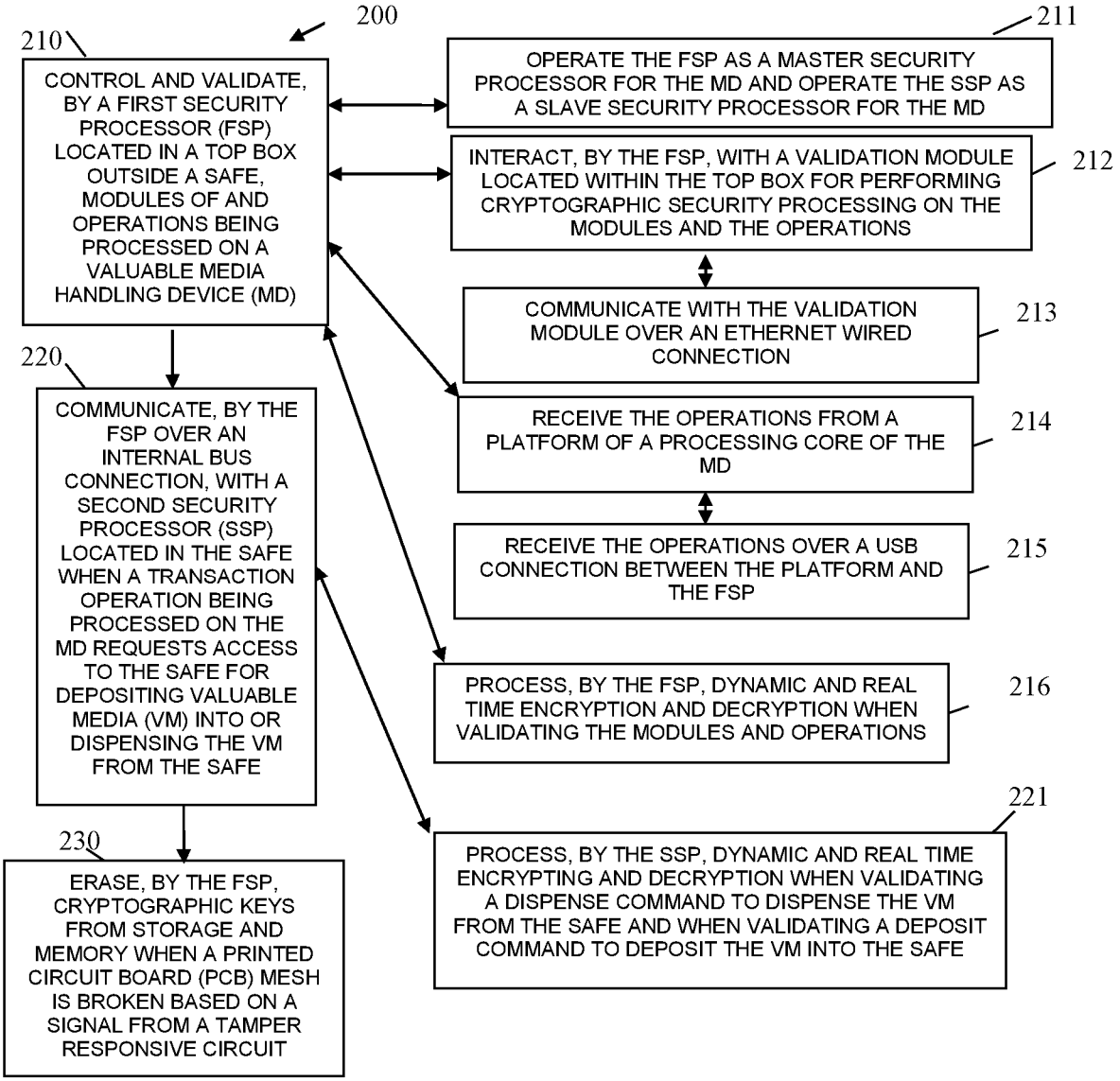
FIG. 2 is a diagram of a method for operating a valuable media handing device with dual security processors, according to an example embodiment.

FIG. 2 is a diagram of a method for operating a valuable media handing device with two security processors, according to an example embodiment. The method 200 is processed on two security processors of a valuable media handling device.

In an embodiment, the method 100 is performed by the valuable media handling device 100.

In an embodiment, the method is performed by the valuable media handling device 100 having the architecture presented in the FIG. 1B.

In an embodiment, the valuable media handling device is a SST. In an embodiment, the SST is an ATM.

In an embodiment, the valuable media handling device is a peripheral device integrated into an SST/ATM.

In an embodiment, the valuable media handling device is a peripheral device integrated into a Point-Of-Sale (POS) terminal.

At 210, the first security processor (located in a top box of the valuable media handling device (outside the safe)) controls and validates modules of and operations being processed on the valuable media handling device.

In an embodiment, at 211, the first security processor operates as a master processor for the valuable media handling device and the second security processor operates as a slave security processor for the valuable media handling device.

In an embodiment, at 212, the first security processor interacts with a validation module located within the top box and performs cryptographic security processing on the modules and the operations.

In an embodiment of 212 and at 213, the first security processor communicates with the validation module over an Ethernet wired connection.

In an embodiment, at 214, the first security processor receives the operations from a processing platform of a processing core of the valuable media handling device.

In an embodiment of 214 and at 215, the first security processor receives the operations over a USB connection between the platform and the first security processor.

In an embodiment, at 216, the first security processor processes dynamic and real-time (on-the-fly) encryption and decryption when validating the modules and the operations.

At 220, the first security processor communicates over an internal bus connection with the second security processor (located within a safe of the valuable media handling device) when a transaction operation being processed on the valuable media handling device requests access to the safe for depositing valuable media into or dispensing the valuable media from the safe.

In an embodiment, at 221, the second security processor performs dynamic and real-time encryption and decryption when validating a dispense command to dispense the valuable media from the safe and when validating a deposit command to deposit the valuable media into the safe.

According to an embodiment, at 230, the first security processor erases cryptographic keys from storage and memory when a PCB mesh is broken based on a signal received from a tamper responsive circuit.

Figure 3:
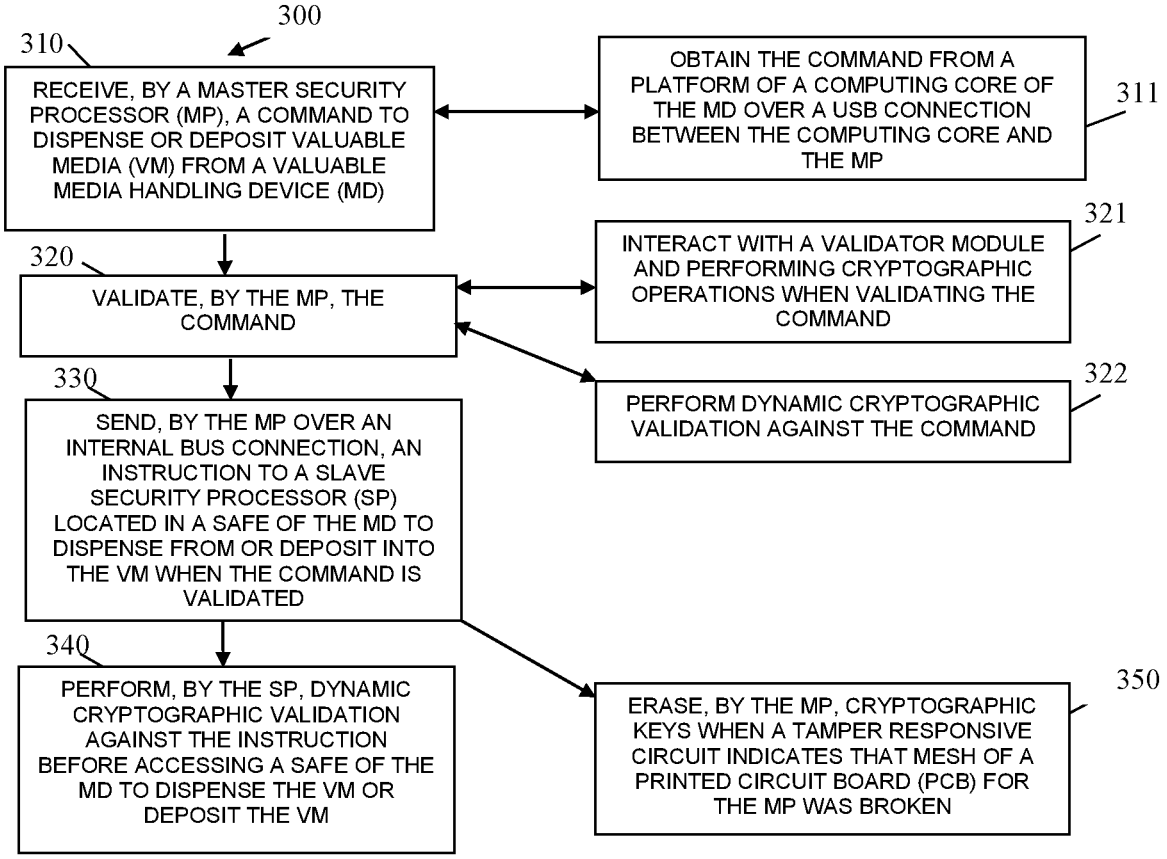
FIG. 3 is a diagram of another method for operating a valuable media handling device with dual security processors, according to an example embodiment.

FIG. 3 is a diagram of another method 300 for operating a valuable media handing device with two security processors, according to an example embodiment. The method 300 is operated by two security processors of the valuable media handling device.

In an embodiment, the method 300 is performed by the media handling device 100.

In an embodiment, the method 300 is performed by the media handling device 100 having the architecture presented in the FIG. 1B.

In an embodiment, the valuable media handling device is a SST. In an embodiment, the SST is an ATM.

In an embodiment, the valuable media handling device is a peripheral device integrated into an SST/ATM.

In an embodiment, the valuable media handling device is a peripheral device integrated into a Point-Of-Sale (POS) terminal.

In an embodiment, the method 300 presents another and in some ways enhance perspective of the processing depicted in the method 200 (presented above with the discussion of the FIG. 2).

At 310, a master security processor receives a command to dispense or deposit valuable media from a valuable media handling device.

In an embodiment, at 311, the master security processor obtains the command from a processing platform of a computing core of the valuable media handling device over a USB connection between the computing core and the master security processor.

At 320, the master security processor validates the command.

In an embodiment, at 321, the master security processor interacts with a validation module and performs cryptographic operations when validating the command.

In an embodiment, at 322, the master security processor performs dynamic cryptographic validation against the command.

At 330, the master security processor sends over an internal bus connection, an instruction to a slave security processor located within a safe of the valuable media handling device to dispense from or deposit into the valuable media when the command is validated by the master security processor.

According to an embodiment, at 340, the slave security processor performs cryptographic validation against the instruction before accessing the safe of the valuable media handling device to dispense the valuable media or deposit the valuable media.

In an embodiment, at 350, the master security processor erases cryptographic keys when a tamper responsive circuit indicates that mesh of a PCB for the master security processor is broken.

Figure 4:
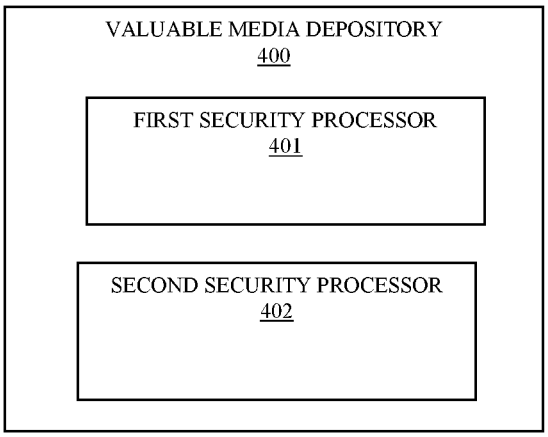
FIG. 4 is a valuable media handling device with dual security processors, according to an example embodiment.

FIG. 4 is a valuable media handling device 400 with two security processors, according to an example embodiment. The valuable media handling device 400 processes valuable media and includes a variety of hardware components, some of which were discussed above with reference to the FIGS. 1A-1B.

In an embodiment, the valuable media handling device 400 is a deposit module.

In an embodiment, the valuable media handling device 400 is a recycler module.

In an embodiment, the valuable media handling device 400 is the valuable media handling device 100 of the FIG. 1A having the architecture presented in the FIG. 1B.

In an embodiment, the valuable media handling device 400 is the depository that performs the method 200 of the FIG. 2.

In an embodiment, the valuable media handling device 400 is the depository that performs the method 200 of the FIG. 3.

In an embodiment, the valuable media handling device 400 is a peripheral device integrated into an SST. In an embodiment, the SST is an ATM. In an embodiment, the SST is a kiosk.

In an embodiment, the valuable media handling device 400 is a peripheral device integrated into a SST and/or POS terminal.

The valuable media handling device 400 includes a first security processor 401 and a second security processor 402.

The first security processor 401 is connected to the second security processor 402 through an internal bus connection. Moreover, the first security processor 401 includes a tamper responsive circuit configured to provide an indication when mesh is broken for a PCB of the first security processor 401, and the first security processor 401 is configured to erase cryptographic keys housed in memory and storage when the indication is received from the tamper responsive circuit.

In an embodiment, the first security processor 401 is further configured to: 1) interface with a computing core of the valuable media handling device 400 to receive commands, 2) cryptographically validate the commands, and 3) provided over the internal bus connection instructions to the second secure processor 402 for accessing the safe when the commands are validated.

In an embodiment of the previous embodiment, the second security processor 402 is further configured to: 1) receive the instructions from the first security processor 401 over the internal bus connection, 2) cryptographically validate the instructions, and 3) activate components of the safe when the instructions are validated in accordance with the instructions.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus the following claims are hereby incorporated into the Description of the Embodiments, with each claim standing on its own as a separate exemplary embodiment.

The invention claimed is:

1. A method, comprising:

controlling and validating, by a first security processor located in a top box outside a safe of a valuable media handling device, modules of and operations being processed on the valuable media handling device, wherein controlling further includes receiving the operations over a Universal Serial Bus (USB) connection between the first security processor and a processing core of a platform that processes transaction applications on a Self-Service Terminal (SST);

wherein controlling and validating further includes:

interacting, by the first security processor, with a validation module located inside the top box along with the first security processor via a wired Ethernet connection between the first security processor and the validation module for performing cryptographic security processing on the modules and the operations;

controlling, by the first security processor, media validation operations being performed and validated on the valuable media handling device for valuable media being transported within the valuable media handling device;

communicating, by the first security processor over an internal bus connection, with a second security processor located in the safe of the valuable media handling device when a transaction operation being processed on the valuable media handling device requests access to the safe for depositing the valuable media into or dispensing the valuable media from the safe, wherein the only connection between the first security processor and the second security processor is the internal bus connection, and wherein the only connection accessible to the second security processor is the internal bus connection to the first security processor; and processing, by the second security processor of the valuable media handling device, media cassette access operations and controlling, by the second secure processor, access to currency cassettes of the valuable media handling device when dispensing the valuable media from a currency cassette or when depositing the valuable media into the currency cassette of the valuable media handling device;

wherein the valuable media handling device is a peripheral device integrated into the SST, wherein the valuable media handling device is a depository.

2. The method of claim 1, wherein controlling and validating further includes operating the first security processor as a master security processor for the valuable media handling device and operating the second security processor as a slave security processor for the valuable media handling device.

3. The method of claim 1, wherein controlling and validating further includes, processing, by the first security processor, dynamic and real time encryption and decryption when validating the modules and operations.

4. The method of claim 1, wherein communicating further includes, processing, by the second security processor, dynamic and real time encrypting and decryption when validating a dispense command to dispense the valuable media from the safe and when validating a deposit command to deposit the valuable media into the safe.

5. The method of claim 1 further comprising, erasing, by the first security processor, cryptographic keys from storage and memory when a Printed Circuit Board (PCB) mesh is broken based on a signal from a tamper responsive circuit.

* * * * *